US009805628B2

(12) United States Patent
Pierson

(10) Patent No.: US 9,805,628 B2
(45) Date of Patent: Oct. 31, 2017

(54) AUGMENTED CAMPAIGN TOOLS

(71) Applicant: Katrina Pierson, Garland, TX (US)

(72) Inventor: Katrina Pierson, Garland, TX (US)

( * ) Notice: Subject to any disclaimer, the term of this patent is extended or adjusted under 35 U.S.C. 154(b) by 0 days.

(21) Appl. No.: 14/932,967

(22) Filed: Nov. 4, 2015

(65) Prior Publication Data

US 2016/0155368 A1 Jun. 2, 2016

Related U.S. Application Data

(60) Provisional application No. 62/074,722, filed on Nov. 4, 2014.

(51) Int. Cl.
*G09F 7/02* (2006.01)
*G09F 13/22* (2006.01)
*G09F 13/02* (2006.01)

(52) U.S. Cl.
CPC ..... *G09F 7/02* (2013.01); *G09F 13/02* (2013.01); *G09F 13/22* (2013.01); *G09F 2013/222* (2013.01)

(58) Field of Classification Search
CPC ..... G09F 7/02; G09F 13/02; G09F 7/18
See application file for complete search history.

(56) References Cited

U.S. PATENT DOCUMENTS 2,872,750 A * 2/1959 Holcomb ..... G09F 7/00 40/606.19
4,660,310 A * 4/1987 Farmer ..... G09F 15/0006 40/606.18
4,864,757 A * 9/1989 Lovett ..... G09F 7/18 24/561
4,878,303 A * 11/1989 Banniza ..... G09F 7/20 40/601
4,885,860 A * 12/1989 Huenefeld ..... G09F 15/0006 40/606.18
5,101,329 A * 3/1992 Doyle ..... F21S 9/037 362/183
7,669,355 B2 * 3/2010 Gronenthal ..... G09F 23/00 40/606.19
8,631,597 B2 * 1/2014 Delorenzo ..... G09F 7/22 40/479
2006/0050528 A1 * 3/2006 Lyons ..... F21S 8/088 362/559

(Continued)

*Primary Examiner* — Gary C Hoge
(74) *Attorney, Agent, or Firm* — Thrasher Associates

(57) ABSTRACT

The invention relates to devices and methods that help deliver dynamic messages, including advertisements on placards, medallions, and lighted campaign signs. The augmented placard of the invention includes two components: a corrugated yard sign and a medallion. A stand holds the corrugated yard sign in a specific position. The corrugated yard design displays the first message, while the emblem contains the second message. The second message is preferably independent of the first message but may be related to the first message. The medallion embeds on the corrugated yard sign by a connecting element that provides a temporary attachment between the medallion and the corrugated yard sign. The placard can contain more than one medallion attached to it. Furthermore, the placard has the provision for attachment of an illumination source to maintain the visibility of the messages in any condition, including when it is dark.

5 Claims, 11 Drawing Sheets

(56) References Cited

U.S. PATENT DOCUMENTS

| | | | | |
|---|---|---|---|---|
| 2006/0130382 | A1* | 6/2006 | Howell | G09F 13/02 40/607.09 |
| 2006/0260161 | A1* | 11/2006 | Hamilton | G09F 13/04 40/541 |
| 2006/0274521 | A1* | 12/2006 | Ullrich | G09F 7/22 362/159 |
| 2007/0159817 | A1* | 7/2007 | Evans | G09F 13/02 362/191 |
| 2007/0193196 | A1* | 8/2007 | Pernici | G09F 7/18 52/714 |
| 2009/0077849 | A1* | 3/2009 | Glass, Jr. | G09F 15/00 40/606.03 |
| 2011/0173854 | A1* | 7/2011 | Pappas | G09F 1/00 40/606.19 |

* cited by examiner

AUGMENTED CAMPAIGN TOOLS

RELATED APPLICATION AND CLAIM OF PRIORITY

The present patent document claims the benefit of the filing date under 35 U.S.C. §119(e) of Provisional U.S. Patent Application Ser. No. 62/074,722 filed on 4 Nov. 2014 to common inventor Katrina Pierson and entitled CAMPAIGN SIGN ENHANCEMENTS, the entire contents of which are incorporated herein by reference.

TECHNICAL FIELD OF THE INVENTION

The present invention relates to the placards, and more particularly to campaign signs and enhancements for campaign signs.

STATEMENT OF A PROBLEM ADDRESSED BY THE INVENTION

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

Placards have been in use for carrying advertisement and notices for centuries. The placards usually comprise of two parts—the first part is a painted or printed advertisement, and the second part holds the first part vertically on the ground or on a building surface. For campaign signs, the first part of the placard is typically made of printed card-stock, corrugated plastic, poly-bag, or other weather-resistant material capable of being printed upon.

Placards are usually printed with attractive marketing material or customized messaging. Once the messages or advertisements are printed on the placard, the message is static—having no further information, means for updating information, or for attracting attention.

Nearly every Fall, Americans are saturated with signs for political campaigns ("yard signs"). Those who are willing to place a sign in their yard can be categorized as: 1) those who place many signs in their yard, resulting in "sign clutter" or "sign noise" that ultimately dilutes the placement value for all candidates having signs in that yard, 2) those who place one or two signs for particular candidates that they support and most typically the candidates at the top of the ticket, and 3) those who place a single sign in their yard for a single "down-ballot" candidate. Of course, far more people find campaign yard signs unsightly and simply refuse to allow one to be placed in their yard. Ultimately, the manner in which people place signs hurts in particular down-ballot candidates.

Additionally, due to the timing of the "General Election," campaign yard signs must compete with Halloween for yard space and visibility. Signs in use today can hardly compete with blower-powered witches and lawn decorations.

Accordingly, what are needed are methods and devices that enable a user to provide best possible visibility of a placard, and the invention provides such an invention.

SUMMARY

In an embodiment, the present invention defines devices and methods to deliver dynamic messages, including advertisements on a placard using emblems. In the augmented placard of the present invention, a corrugated yard sign containing the first message is mounted on a stand. An emblem that contains a second message is mountable/embeddable on the corrugated yard sign. The second message displayed on the emblem is related to the first message displayed on the corrugated yard sign. In an alternative embodiment, the second message is independent of the first message. The emblem is attached to the corrugated yard sign using a connecting element made of sign wire.

In another embodiment, the stand contains two triangular legs; wherein the first leg and second leg are coupled to each other through a bridge. The bridge is configured to couple to at least one corrugated yard sign and each leg is contoured such that it penetrates the ground surface. The bridge contains the illumination source across its corners along the sides of the corrugated yard sign for providing high visibility when the ambient light is low. The illumination source draws power from the battery connected to it. In an alternative embodiment, the illumination source can be attached to the stand using a connecting element.

In another embodiment of the invention, an emblem embeds on the corrugated yard sign by a connecting element that provides a temporary attachment between the emblem and the corrugated yard sign.

In yet another embodiment of the invention, the placard has more than one emblem attached to the corrugated yard sign using connecting elements.

In an alternative embodiment of the invention, the illumination source is printed on the emblem or the corrugated yard sign. The illumination source further draws power for its functioning from a battery source such as thin film battery or thin film solar panel.

BRIEF DESCRIPTION OF THE DRAWINGS

Various aspects of the invention, as well as an embodiment, are better understood by reference to the following exemplary embodiment. For better understanding of the invention, the exemplary embodiment should be read in conjunction with the drawings in which.

EXEMPLARY EMBODIMENT

Interpretation Considerations

Figure 1:
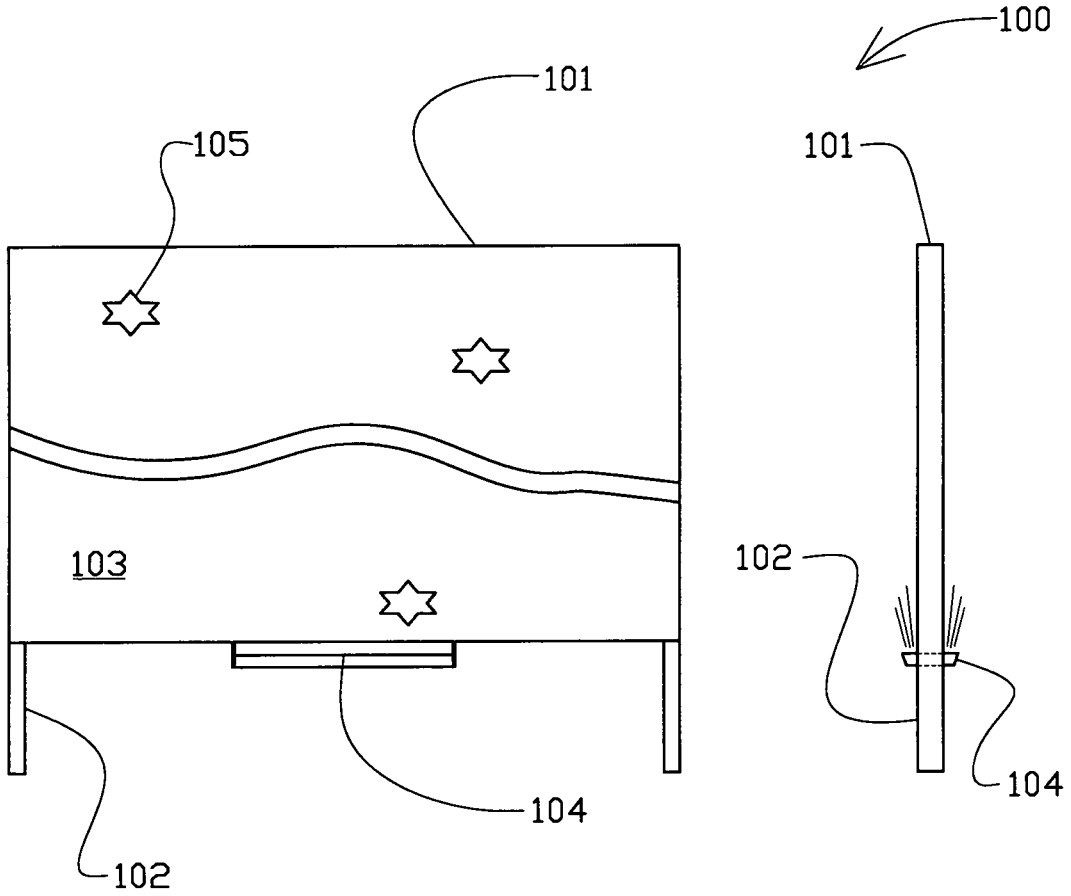
FIG. 1 illustrates front view and the side view of an exemplary placard.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time of patent filing. Since one of ordinary skill in the art may recognize equivalent structures or equivalent acts to achieve the same results in exactly the same way in light of the following exemplary embodiment, or to achieve the same results in a not dissimilar way; the following exemplary embodiment should not be interpreted as limiting the invention to one embodiment.

Likewise, individual aspects (sometimes-called species) of the invention are provided as examples. Accordingly, one of ordinary skill in the art may recognize from a following exemplary structure (or a following exemplary act) a substantially equivalent structure or substantially equivalent act to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated. (For example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning—" or "step for—functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary plain meaning and interpretation, unless indicated otherwise.

As will be understood by those of ordinary skill in the art, various structures and devices are depicted in block diagram form in order to avoid unnecessarily obscuring the invention. It should be noted in the following discussion that acts with like names are performed in like manners, unless otherwise stated.

Of course, the foregoing discussions and definitions are provided for clarification purposes and are not limiting.

Description Of The Drawings

Better understanding of the invention can be obtained by examining the figures, wherein FIG. 1 illustrates one embodiment of a device 100 according to the teachings of the invention. In FIG. 1 an augmented placard 100 comprises a corrugated plastic yard sign 101 having multiple stars 105 printed thereon. The corrugated yard sign 101 has a print area 103 to display a message, and preferably a political campaign message. The placard 100 has a stand 102 over which the corrugated yard sign 101 gets mounted (the stand 102 includes a horizontal member (not shown) that provides additional support to the sign 101-stand 102 combination). Additionally, an illumination source 104 is couplable to the stand 102 (and/or couplable to the sign 101) of the placard 100 so that a message on the sign 101 is visible in low light conditions. Furthermore, a detachable illumination source 104 can be coupled to the placard 100 using various connecting elements such as thin wire, clamps, clips, or any other low cost connecting made of thin wire or plastic, or equivalents.

Figure 2:
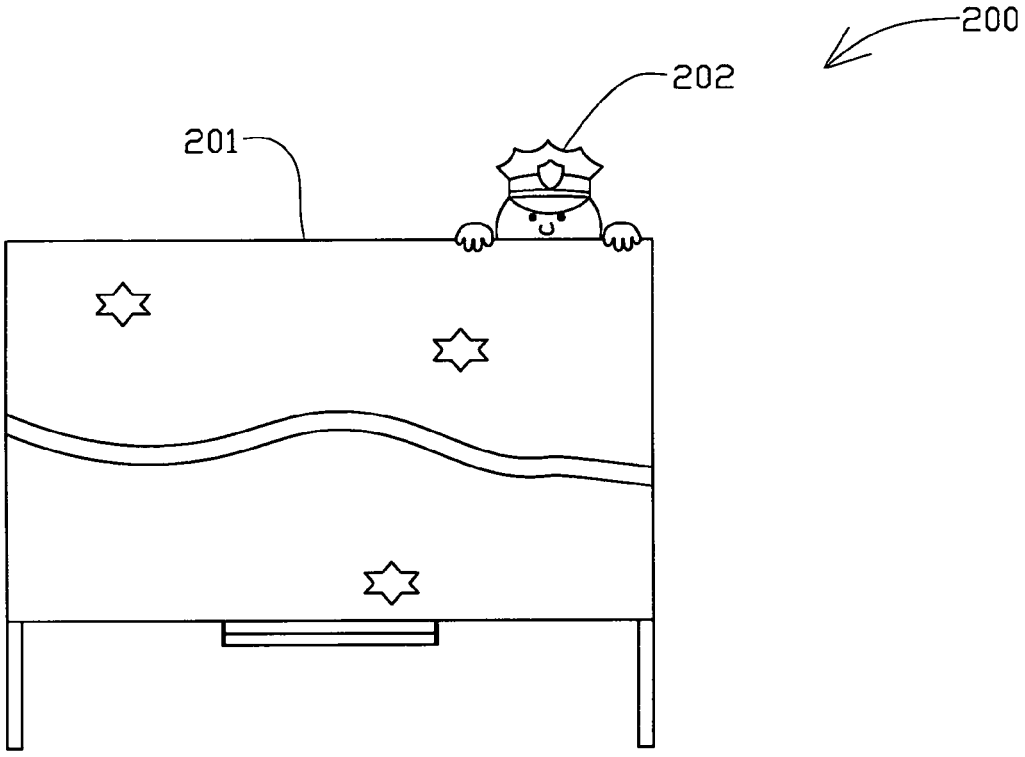
FIG. 2 shows an emblem attached to the exemplary placard.

Emblems are any secondary messaging platforms coupled to a campaign sign, such as plain medallions, or stylized shapes such as uniform officers or badges, for example. FIG. 2 demonstrates an example of an emblem 202. Here, the emblem 202 is a designer logo that couples to the top of the corrugated yard sign 201 using the connecting element. The connecting element (not visible in the figure) in this case is a plastic hook. Accordingly, emblems are can be in any form or shape—such as a cop hat, fireman's helmet, or any other shape associated with a logo, cause or personal or professional achievement, for example.

Figure 3:
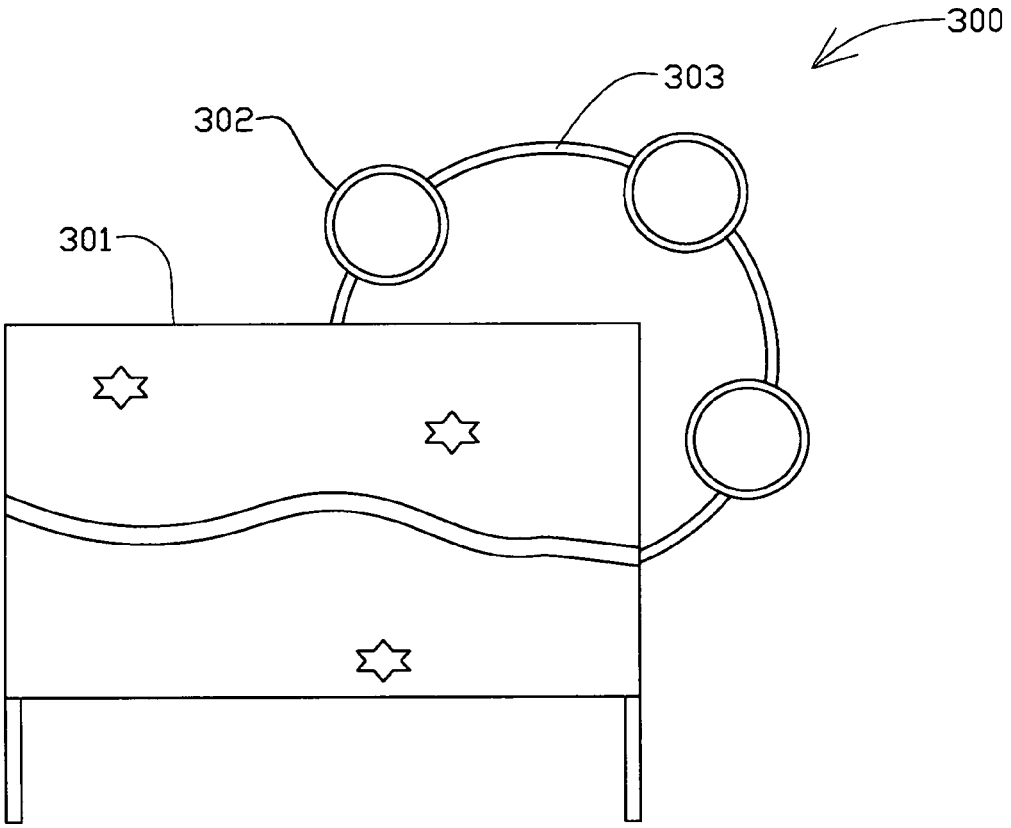
FIG. 3 shows an emblem attached to the exemplary placard.
Figure 4:
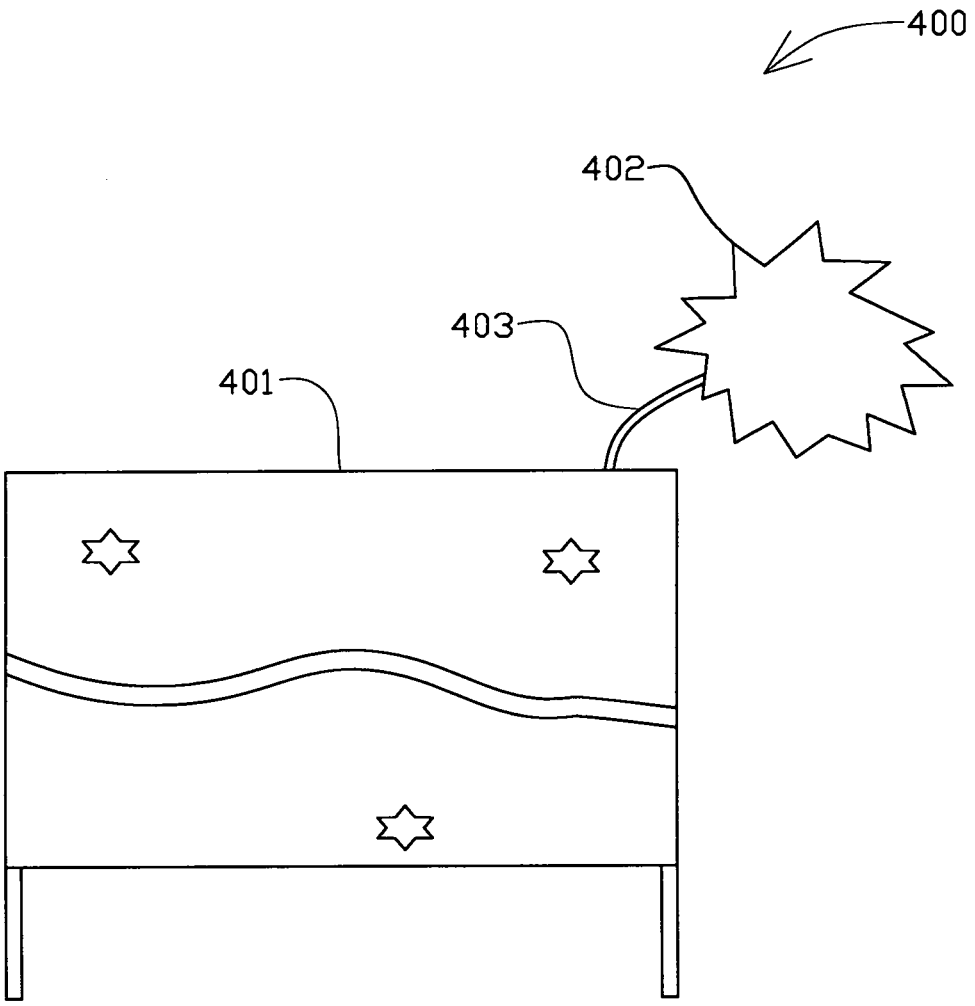
FIG. 4 shows an emblem attached to the exemplary placard.
Figure 5:
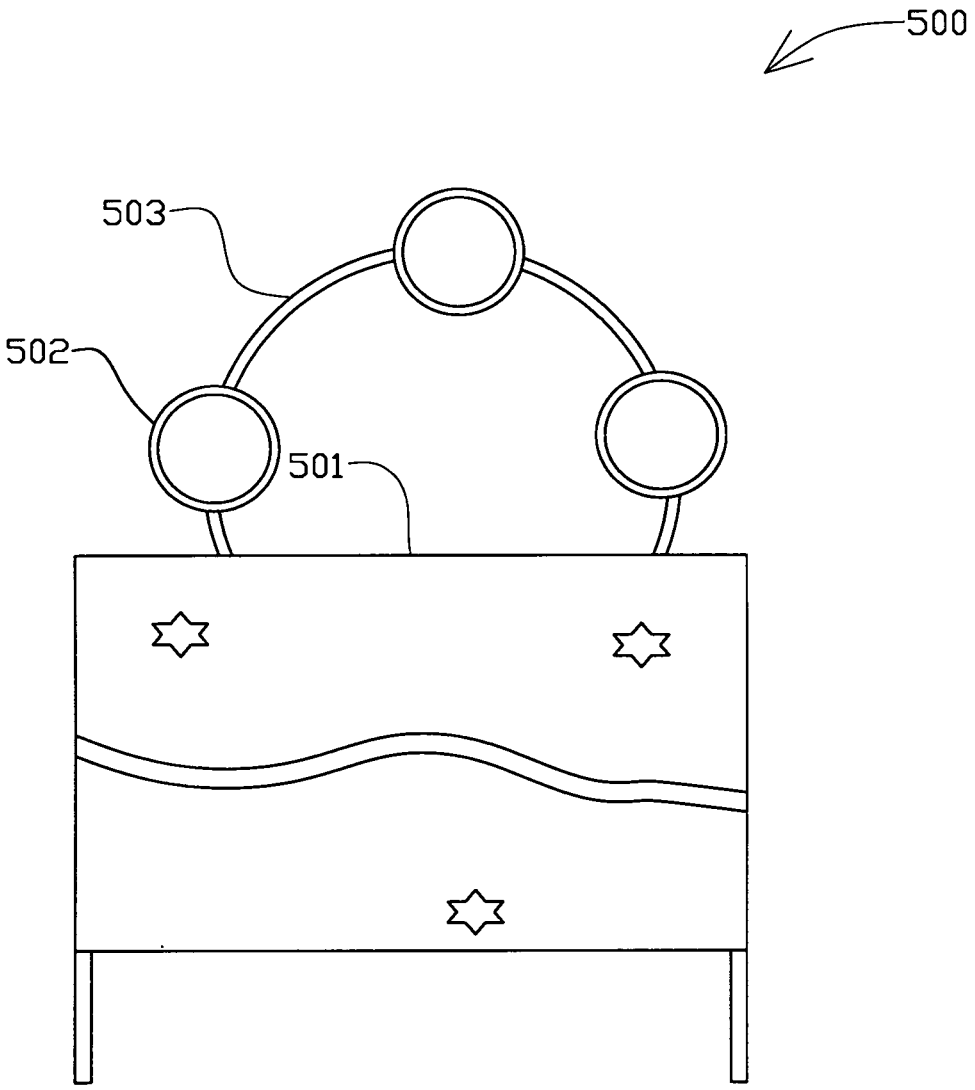
FIG. 5 shows an emblem attached to the exemplary placard.

FIG. 3 illustrates an exemplary embodiment in which a placard 300 contains the corrugated yard sign 301 having circular attention-grabbing emblems 302 thereon, where the emblems 302 are coupled to each other and the sign 301 using via a wire 303. Additionally, FIG. 4 shows an augmented placard 400 having an emblem 402 which has an attention-getting explosion shape. The emblem 402 is coupled to a top corner to the corrugated yard sign 401 via a connecting elements 403. Similar to FIG. 3, FIG. 5 shows an augmented placard 500 with a plurality of emblems 502 coupled to the top of a sign 501 via a wire 503 that is bent into a circular shape.

Figure 6:
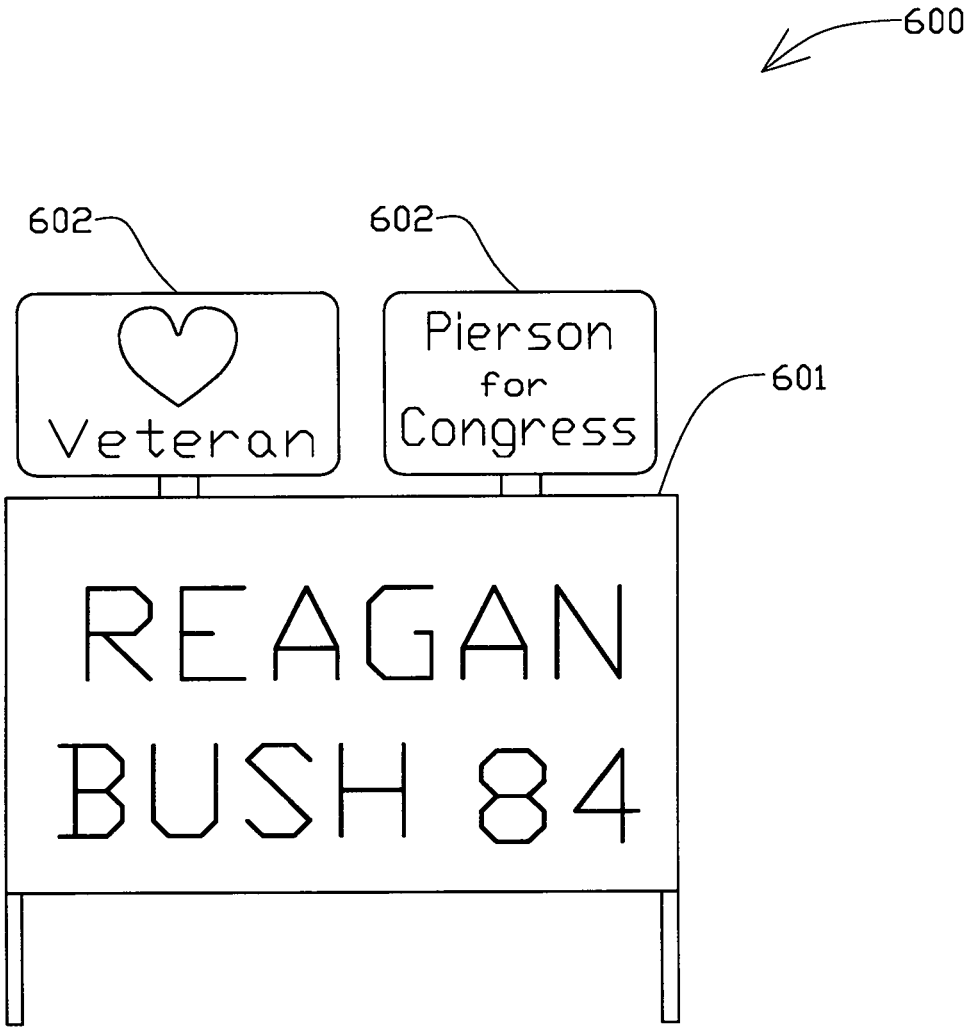
FIG. 6 shows two emblems attached to the exemplary placard.

In an alternative embodiment, more than one emblem can be attached to the corrugated yard sign as shown in the FIG. 6, which illustrates campaign medallion embodiments. Campaign medallions are typically smaller than a campaign sign and preferably carry messaging that is different from the campaign sign. For example, the medallion may be shaped like a "killroy was here" to draw attention, and identify with the user of the medallion, such as an army veteran. Accordingly, medallions are highly customizable. Other shapes, such as a cop hat, fireman's helmet, or any shape associated with a logo or cause could be used, for example. In one embodiment, a medallion may have a removable sticky-tape on one side so that the medallion may be attached to a door or other flat surface. This also makes the medallions easier to pass out by block walkers or to mail to a supporter of a political campaign (and, thus, medallions preferably have printed thereon a political campaign message different from or in augmentation of a message of a campaign sign to which they are attached). Medallions may also be coupled to the yard sign via sign wires or clip directly to the yard sign, for example. In an alternative embodiment, the medallion can be QR Coded or associated with an image capturing software that directs users of mobile devices to landing pages about the person or candidate. In yet another embodiment the medallion or yard sign may incorporate at least one 3-dimensional image. It is be better understood from the various illustrations discussed above that the emblem can be coupled with the placard at any possible point. Moreover, the shape of the emblem is also not restricted to any particular type. The material of the yard sign and the emblem is selected so that the emblem can be embedded on to the yard sign using low cost connecting elements such as wire adapted to be locked with stand or the corrugated yard sign. The emblem can also be made of the corrugated sheet depending upon the connecting element used. When the connecting element is thin wire and is inserted between the emblem and the yard sign to connect them together, the corrugated sheet is preferred to make the process of embedment easy. In an alternative embodiment, a plastic clamp can be used connect the emblem with the placard.

In another embodiment, a three dimensional emblem with radium coating can also be used. The coating of radium on the emblem illuminates in low ambient light. Alternatively, any new printable technology can be used to illuminate, display images (including moving images), or otherwise augment the emblem or sign.

Figure 7:
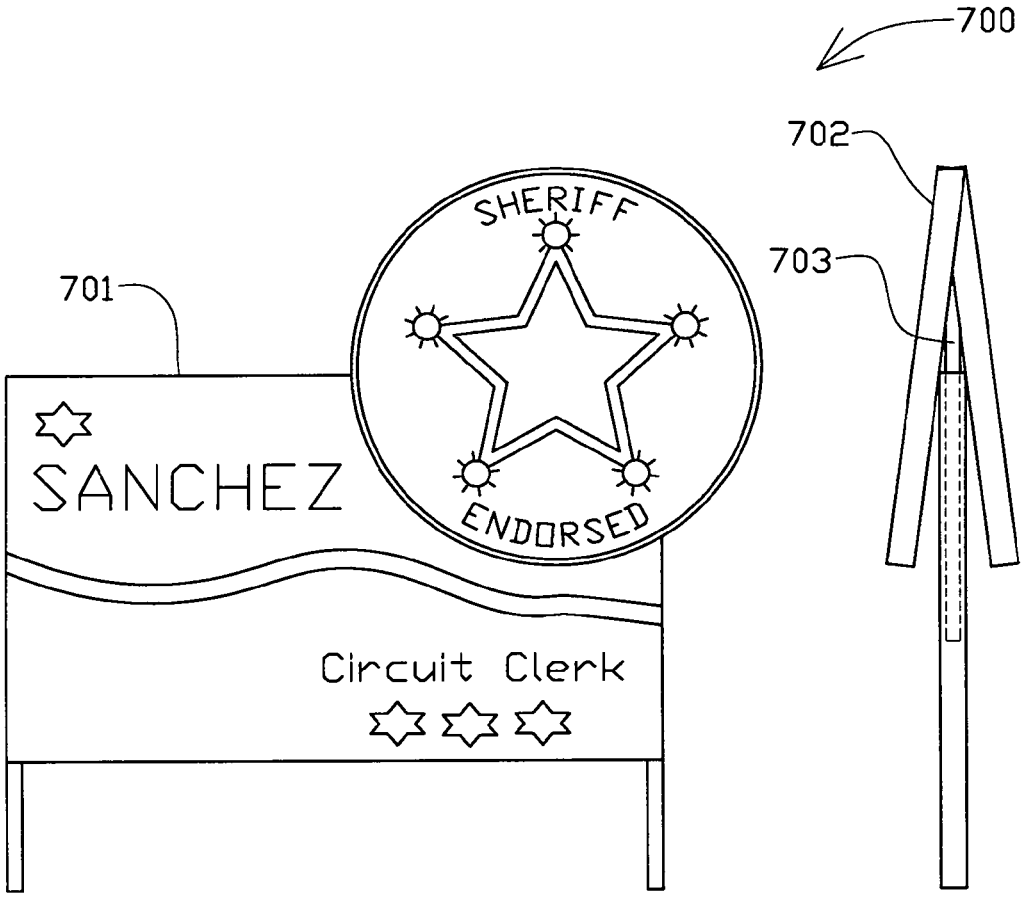
FIG. 7 shows an emblem attached to the exemplary placard and the exemplary connecting element.
Figure 8:
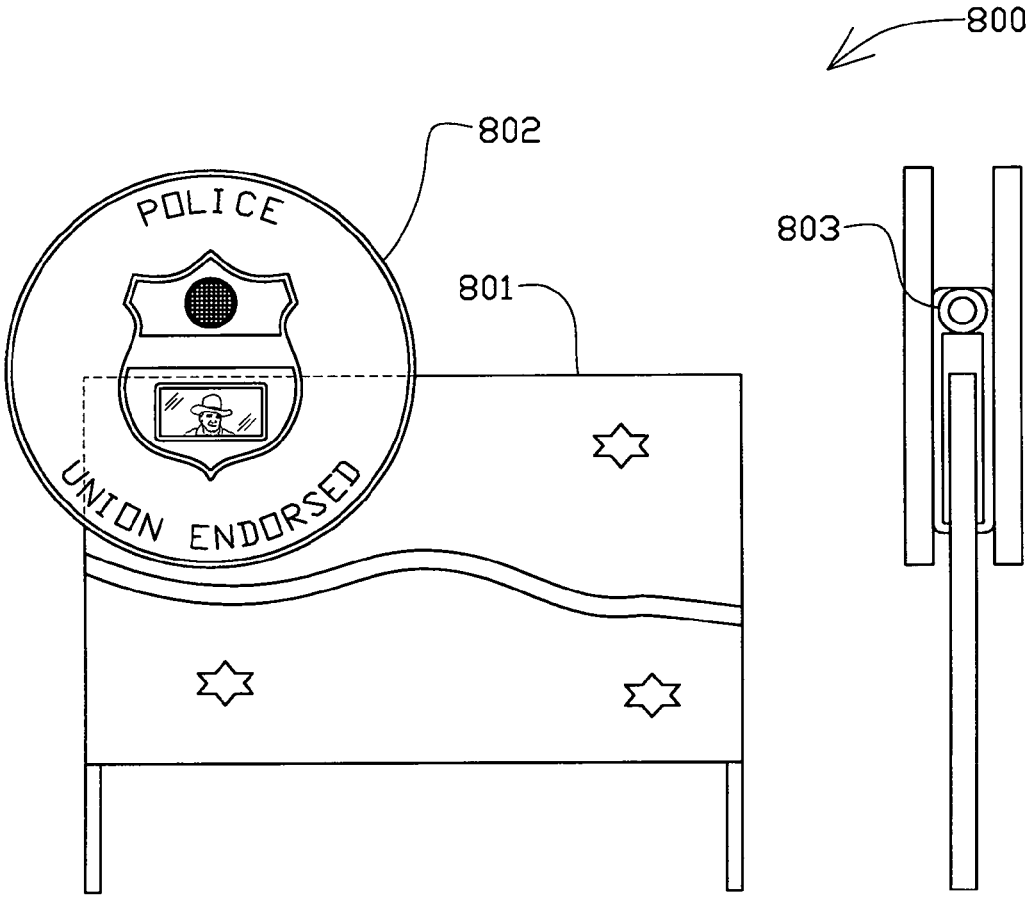
FIG. 8 shows an emblem attached to the exemplary placard and the exemplary connecting element.

FIGS. 7 and 8 illustrate alternative connecting elements for attaching an emblem to a placard or sign. For example, in FIG. 7, the connecting element is a rod 703 that passes through the corrugated yard sign 701 and connects to the emblem 702. Alternatively, in FIG. 8 a clip 803 is used to connect the emblem 802 with the corrugated yard sign 801. Accordingly, connecting elements made of wire or plastic can be used in accordance with the present invention.

Figure 9:
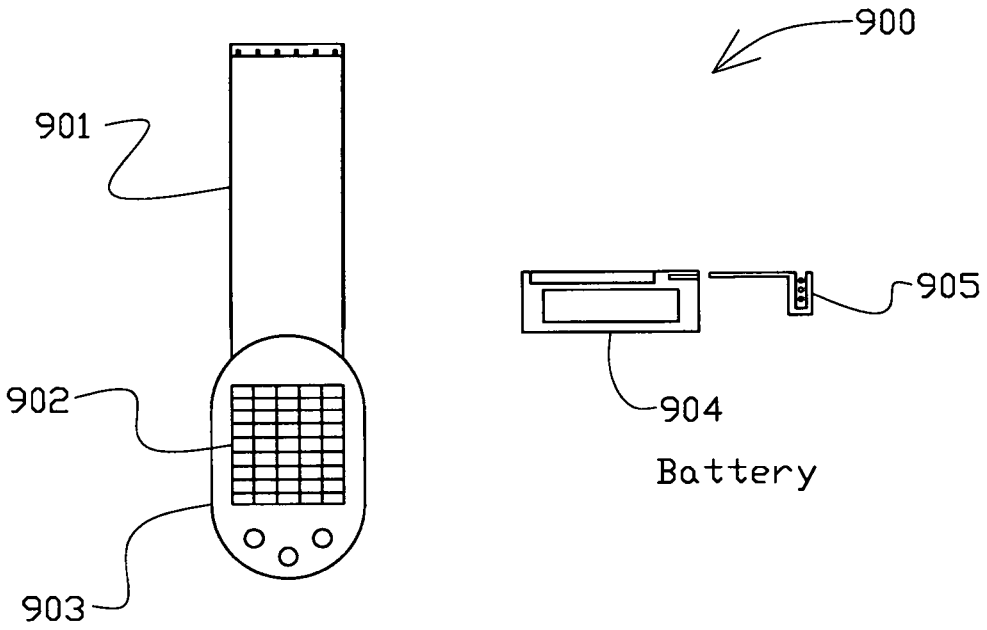
FIG. 9 is a top and side view of an exemplary illumination source.
Figure 10:
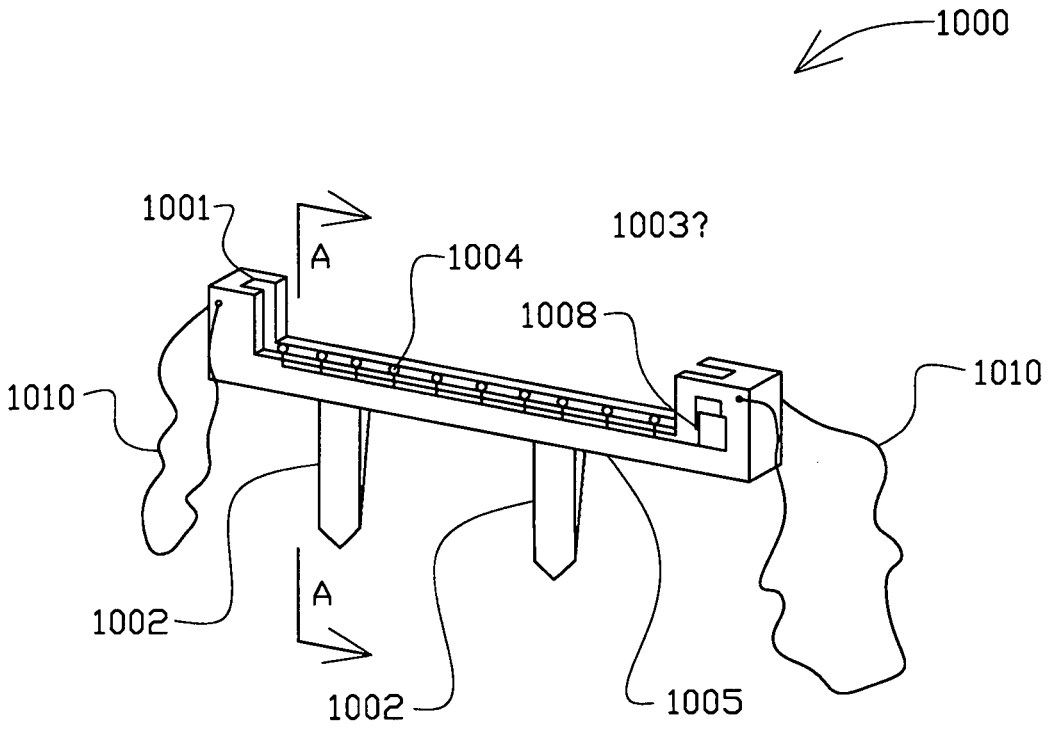
FIG. 10 shows a perspective view of the exemplary stand.

FIG. 9 illustrates an attachable illumination device 900. Here, an illumination source 903, such as one or a plurality of LEDs, OLEDs, or any other illumination source receives power from an energy source such as a battery 904 embedded or attached to the detachable illumination device 900. Here, the battery 904 is charged via a solar source embodied as a thin film solar panel 902, and the battery 904 is placed inside the illumination assembly 907. In alternative embodiment, the energy source comprises a thin film solar panel coated on the corrugated yard sign or the emblem. The illumination device 900 is attached to the stand through the connecting element 901. The connecting element 901 is a clip-arm comprising a wire folded to create a tine/teeth endowed clamp 905. The connecting element 901 has flexible connection arm (so that the illumination device can be angled to best illuminate a sign or other object—in other words, so that the projection of light can be adjusted in various directions). The clamp 905 enables the illumination device 901 to be placed at top or bottom of a placard or sign. A manual switch (not shown) on the illumination device 901 controls the operation of the illumination source(s) 903. In alternative embodiment, a light sensor/photo sensor is embedded in the illumination device 901 (including the solar panel 902) to provide automatic activation of the illumination source(s) 903.

An inventive stand 1000, as shown in the FIG. 1, is used to enhance signs such as corrugated plastic signs. The stand 1000 comprises two triangular legs 1002, each leg being contoured to penetrate a ground surface. Further, the triangular legs 1002 couple to each other via a bridge 1005. The bridge 1005 is configured to couple to at least one corrugated yard sign through a receiving channel 1001 which traverses across the interior length of the bridge. Moreover, the receiving channel 1001 of the bridge 1005 maintains an LED strip 1004 across its length, by which the LEDs are able to illuminate a corrugated yard sign. The illumination source / LED strip 1004 is powered by a battery which is on/off articulatable via a manual switch 1008 on the bridge 1005. To provide automatic switching, a programmable timer or photo diode can placed to articulate the LED strip 1004. The stand 1000 also includes tie-downs 1010, that are coupled to the bridge 1005 via pins, for securing a sign to the stand 1000.

Figure 11:
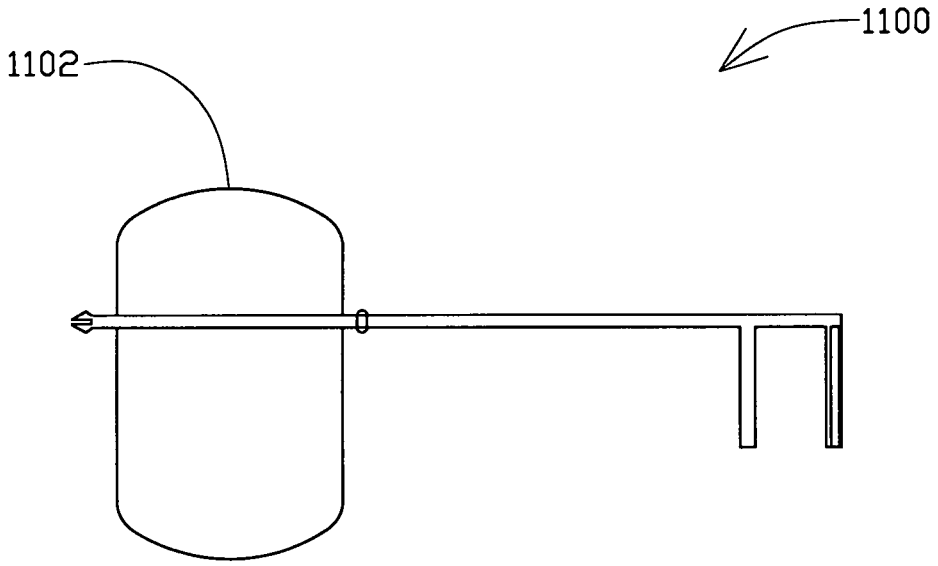
FIG. 11 shows a perspective view of the exemplary stand.

LEDs (either solar or battery powered) can be used to enhance both medallions as well as the campaign signs. For example, LEDs can be used to: a) change colors to draw attention to a sign, b) light-up a sign so that it can be easily seen at night, c) create lighting effects in corrugated plastic signs. Additionally, a power source could be used to power sounds, start/stop a recorded message, or even play a video via a device such as a printed video system under development by Texas Instruments®. In one embodiment, the LEDs are attachable (such as through a wire stand or clip(s)) to corrugated signs and extend away from the sign and the light they generate is directed to the sign. FIG. 11 illustrates the exemplary connecting element 1100 that be used to connect an emblem 1102 to a corrugated yard sign (not shown).

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and any appended claims. It is indeed intended that the scope of the invention should be determined by proper interpretation and construction of any appended claims and their legal equivalents, as understood by those of skill in the art relying upon the disclosure in this specification and the attached drawings.

One embodiment of the invention is an augmented placard. This embodiment of the augmented placard includes a corrugated yard sign mounted on a stand exhibiting a first message. The stand has a first triangular leg and a second triangular leg, and each leg is contoured to penetrate the ground surface. The first leg and second leg are coupled to each other via a bridge. The bridge includes a channel, and the channel is configured to couple to a corrugated yard sign. The channel also has an illumination source that, when on/activated, illuminates the corrugated yard sign. The embodiment may also include an emblem exhibiting a second message attached to the corrugated yard sign via a connecting element.

The illumination source of the placard is preferably a low cost Light Emitting Diode (LED), and could be attached to the bridge using the connecting element. Additionally, the connecting element could be a thin wire folded in such a way to get snap fit on the bridge of the stand. Furthermore, the illumination source could be powered by a thin film solar panel coated on the corrugated yard sign.

What is claimed is:

1. An augmented placard, comprising:

a corrugated yard sign mounted on a stand exhibiting a first message;

the stand has a first triangular leg and a second triangular leg, each leg contoured to penetrate the ground surface, the first leg and second leg being coupled to each other via a bridge, the bridge having a channel, and the channel being configured to couple to a corrugated yard sign; and the channel comprising an illumination source therethrough to illuminate the corrugated yard sign.

2. The augmented placard according to the claim 1 wherein the illumination source is a Light Emitting Diode (LED).

3. The augmented placard according to the claim 1 wherein the illumination source is attached to the bridge using a connecting element.

4. The augmented placard according to the claim 3 wherein the connecting element is thin wire folded in such a way to get snap fit on the bridge of the stand.

5. The augmented placard according to the claim 1 wherein the illumination source is a powered by a thin film solar panel coated on the corrugated yard sign.

* * * * *